US005314262A

United States Patent [19]

Meisinger et al.

[11] Patent Number: 5,314,262

[45] Date of Patent: May 24, 1994

[54] HOISTING GEAR ON THE TROLLEY OF A CONTAINER CRANE

[75] Inventors: Eduard Meisinger, Wendelstein; Herbert Steiner, Schwabach, both of Fed. Rep. of Germany

[73] Assignee: Man Gutehoffnungshuette Aktienegesellschaft, Oberhausen, Fed. Rep. of Germany

[21] Appl. No.: 991,739

[22] Filed: Dec. 17, 1992

[30] Foreign Application Priority Data

Dec. 23, 1991 [DE] Fed. Rep. of Germany ..... 4142779

[51] Int. Cl.[5] ..... B63B 27/00; B66C 11/02

[52] U.S. Cl. ..... 414/137.1; 414/140.3; 414/141.3; 414/142.8; 414/141.7; 212/205; 212/146; 212/147

[58] Field of Search ..... 414/137.1, 137.7, 139.4, 414/139.9, 140.3, 140.4, 141.3, 141.4, 141.5, 141.6, 142.6, 142.7, 142.8; 212/205, 206, 216, 217, 225, 227, 228, 214, 216, 146, 147; 254/290, 278, 291, 292

[56] References Cited

U.S. PATENT DOCUMENTS

| | | | |
|---|---|---|---|
| 2,675,131 | 4/1954 | Osojnak et al. . | |
| 3,899,083 | 8/1975 | Flessner et al. | 212/147 |
| 3,958,106 | 5/1976 | Bedford et al. | 414/141.4 |
| 4,858,775 | 8/1989 | Crouch | 212/205 |

FOREIGN PATENT DOCUMENTS

| | | | |
|---|---|---|---|
| 1506495 | 7/1969 | Fed. Rep. of Germany . | |
| 2012771 | 12/1970 | Fed. Rep. of Germany . | |
| 2752212 | 5/1979 | Fed. Rep. of Germany | 212/205 |
| 3440013 | 5/1986 | Fed. Rep. of Germany | 212/147 |
| 3710436A1 | 10/1988 | Fed. Rep. of Germany . | |
| 3727329A1 | 3/1989 | Fed. Rep. of Germany . | |
| 3727329 | 3/1989 | Fed. Rep. of Germany | 212/147 |
| 3830429A1 | 3/1990 | Fed. Rep. of Germany . | |
| 280739A | 7/1990 | German Democratic Rep. . | |
| 725431 | 11/1966 | Italy | 212/205 |
| 530842 | 12/1976 | U.S.S.R. | 212/147 |
| 1370050 | 1/1988 | U.S.S.R. | 212/147 |

*Primary Examiner*—Michael S. Huppert
*Assistant Examiner*—R. B. Johnson
*Attorney, Agent, or Firm*—McGlew and Tuttle

[57] ABSTRACT

A hoisting arrangement for a trolley (1) of a container crane with two motor-driven cable drums (2*a*, 2*b*), with cable rollers (4*a*–4*d*) arranged on the roller traverse (5), and with hoisting cables (3*a*–3*d*) guided between the cable fixed points (8*a*–8*d*) and the cable drums (2*a*, 2*b*). Hoisting arrangement provides cable drums (2*a*) and (2*b*) arranged, together with their drives (6*a*, 6*b*, 7*a*, 7*b*), offset in parallel by the drum diameter (12). A maximum cable distance (10) with fully wound cable drum (2*a*, 2*b*) is provided to correspond approximately to the distance (11) of the cable roller pairs (4*a*, 4*b*) and (4*c*, 4*d*) on the roller traverse (5), as well as approximately to the distance (9) of the cable fixed points (8*a*, 8*b*) and (8*c*, 8*d*) on the trolley frame (1). The cable drums (2*a*, 2*b*) are of double-thread design. During lowering, the cables (3*a*, 3*b*, 3*c*, 3*d*) run on the cable drums (2*a*, 2*b*) in the inward direction and define the cable runoff path (15).

2 Claims, 1 Drawing Sheet

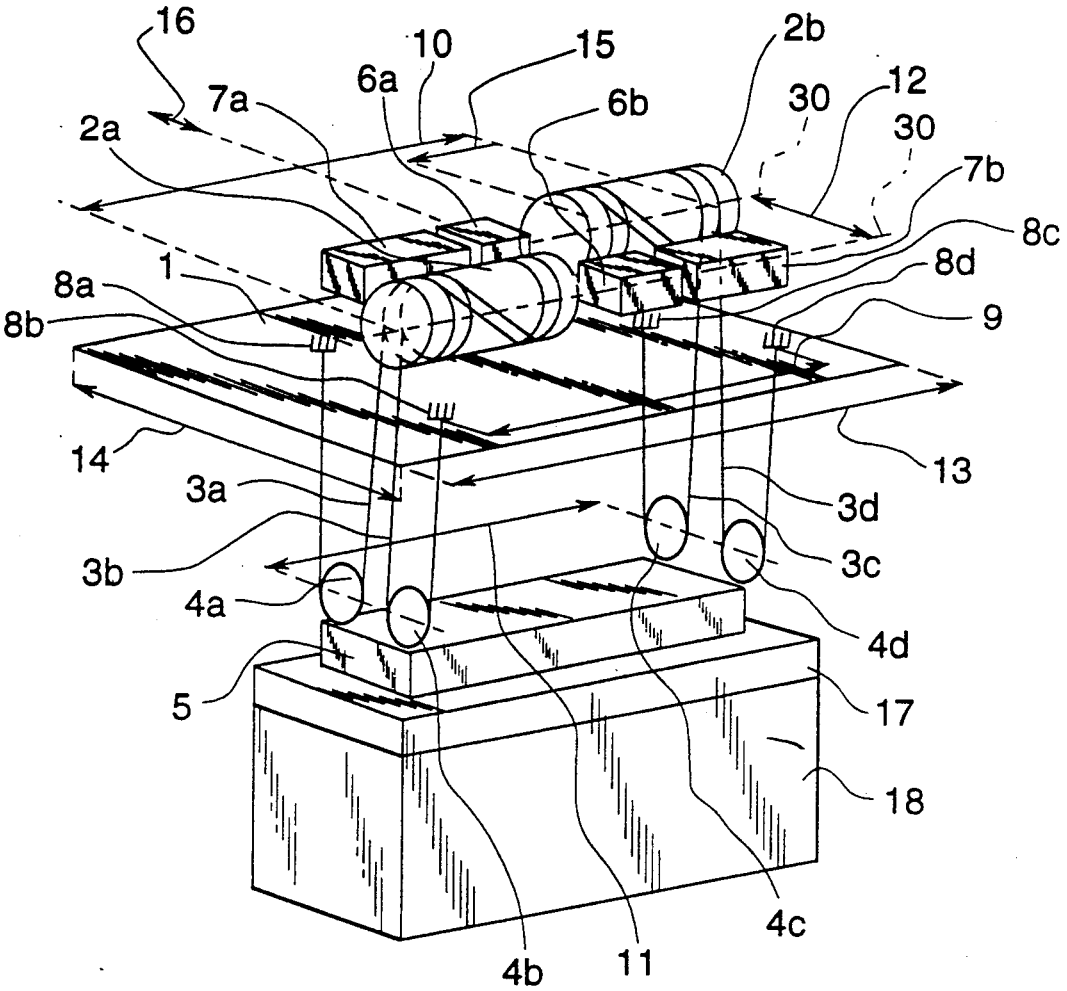
16
10
15
2b
7a
6a
6b
30
12
30
2a
7b
8c
1
8d
8a
9
8b
14
13
3a
3d
3b
3c
4a
4d
5
17
18
4c
4b
11

HOISTING GEAR ON THE TROLLEY OF A CONTAINER CRANE

FIELD OF THE INVENTION

The present invention pertains to a hoisting gear or hoisting drum and cable arrangement on a trolley of a container crane with two motor-driven cable drums, with cable fixed points arranged on the frame of the trolley, with cable rollers arranged on the roller traverse or support, as well as with hoisting cables guided between the cable fixed points and the cable drums.

BACKGROUND OF THE INVENTION

In a prior-art arrangement of the hoisting gear on the trolley of container cranes, the two cable drums are arranged in one axis on the trolley frame, while the drive motors with braking means, which are offset in parallel, transmit their power either to a common, centrally arranged transmission gear or to two separate transmission gears of each cable drum.

In this arrangement and design of the cable drums on the trolley, the distance between the center of the respective cable drums, on which the hoisting cables run off, approximately corresponds to the distance between the cable rollers of the roller support and approximately to the distance between the cable fixed points on the trolley frame.

Since one cable each runs off from the cable drum in the outward direction during the lowering of the roller support, this arrangement influences the length of the hoisting gear and that of the trolley, and consequently also the clearance of the container crane, e.g., in relation to ship structures to be loaded and unloaded.

SUMMARY AND OBJECTS OF THE INVENTION

It is the object of the present invention to provide a hoisting gear means consisting of cable drums, transmission gears, drive motors, and braking means, as well as a design of the cable drums themselves, in which the trolley as a whole can be designed having a more compact and shorter design.

According to the invention, a container crane trolley hoisting gear arrangement is provided including two motor driven cable drums, fixed cable points associated with the trolley, preferably arranged on the frame of the trolley, cable rollers arranged on a roller support (associated with a spreader engaging a container which is to be loaded or unloaded), as well as hoisting cables guided between the cable fixed points and the cable drums. The cable drums are of a double-thread design wherein each of the cable drums feeds of two cables. The cable drums, together with their drives, are supported on the trolley in parallel and offset by a drum diameter. The distance between the cable supported by a first drum and cable supported by a second drum approximately corresponds to a spacing distance between a first set of rollers and second set of rollers on the roller support when the cable drum is fully wound with cable (the roller support and spreader are in an upper most position). The distance between the cable fixed points of cables from the first drum and the fixed points of cables from the second drum likewise corresponds approximately to the distance between the first set of cable rollers and the second set of cable rollers. The first set of cables on the first drum and the second set of cables on the second drum run off the drum in an inward direction (the first set of cables move inwardly, towards the second set of cables and the second set of cables move inwardly towards the first set of cables as they run off during lowering).

The compact and shorter design of the trolley according to the present invention also permits, e.g., in a container crane with double support system, to reduce the width of the water-side jib and of the land-side support for receiving the trolley.

The arrangement of the hoisting gear on the trolley of container cranes according to the present invention causes the weight of the trolley to decrease due to the shorter and compact design of the trolley frame, and the wind-exposed surface and the trolley traveling drive can be reduced. Consequently, the reduction of the trolley weight favorably affects the weight of the entire container crane, the wheel pressures, and the traveling drive.

Due to the arrangement of the cable drums according to the present invention, the maximum distance between cables on the drums corresponds to the distance between the cable rollers on the roller support as well as to the distance between the cable fixed points on the trolley frame.

Since the drums are of double-thread design (wherein two cables are fed off the same drum), both cables run in the inward direction during the unwinding of the cables from the drum, i.e., during the lowering of the roller support. The distance between the cables does not increase. The two cable drums are arranged on the trolley offset in parallel by the drum diameter.

The width of the trolley is also reduced due to the insertion of sun-and-planet gears or vertically arranged spur gearings between the drive motors and the cable drums.

Electric or hydraulic motors, which transmit their torque to the sun-and-planet gears or spur gearings arranged in front of the cable drums, may be used as drive units.

The sun-and-planet gear may be installed either between the cable drum and the drive motor or in the cable drum itself.

As an alternative, the cable drums may also be driven via high-torque hydraulic motors, i.e., low-speed motors.

Finally, the trolley of the container crane may also be designed as a rotary trolley with a traveling top part and a hoisting platform with integrated, likewise rotating operator's cab, which platform is attached to the top part via a rotary connection.

It is a further object of the invention to provide a container crane trolley cable and hoisting drum arrangement which is simple in layout and facilitates ease of use and maintenance and shortens the overall dimensions of the trolley.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

The only FIGURE is a schematic representation of a trolley frame connected by cables to a roller support associated with a spreader for loading and unloading containers.

DETAILED DESCRIPTION OF THE PREFERRED EMBODIMENT

Referring to the drawing in particular, the invention comprises an arrangement for hoisting gear or a hoisting drum and cable arrangement for a trolley frame 1 supporting a spreader 17 via a roller support 5 for unloading and loading containers 18. The schematic drawing does not shown the container crane, water-side jib or land-side support. The trolley supports a first driven cable drum 2a and a second driven cable drum 2b wherein the first driven cable drum 2a is driven by a drive motor of an electric or hydraulic motor type 7b via a gear mechanism such as a spur gear or sun and planet gear 6b (the gear mechanism as 6b may also be provided within the interior of the drum). The second cable drum 2b is likewise driven by a drive motor 7a (electric or hydraulic type motor) via a gear mechanism (spur gear or sun and planet gear) 6a. A first set of cable rollers 4a, 4b are arranged at left side corners of the roller support (or roller traverse) 5 and a second set of rollers 4c, 4d are arranged at the right hand corners of the roller support 5. The cable drum provides a double thread-design wherein hoisting cables 3a and 3b are fed off of the first cable drum 2a allowing the rollers 4a and 4b to the cable supports 8a and 8b. In a similar manner, the double-thread design allows for feed off of cables 3d and 3c around cable rollers 4c and 4d to cable supports 8c and 8d at the trolley frame 1.

The cable drums 2a and 2b with the gear mechanisms 6a and 6b and drive motors 7a and 7b are arranged on the trolley frame 1. These drums 2a, 2b are arranged in parallel on both the left-hand side and the right-hand side, with central axis 30 offset (in a depth direction) by a drum diameter 12 (the drums 2a, 2b preferably have an equal diameter 12).

The cables 3a, 3b run from the cable drum 2a over the cable rollers 4a, 4b of the roller support 5 to the cable fixed points 8a, 8b.

The cables 3c, 3d run from the cable drum 2b to the cable fixed points 8c, 8d over the cable rollers 4c, 4d of the roller support 5.

The leading dimensions of the trolley 1 are defined by the distance 13 in terms of length and by the distance 14 in terms of width. In the design according to the invention, the maximum cable distance 10 with the cable drum 2a, 2b fully wound approximately corresponds to the distance 11, the distance between the cable roller pairs 4a, 4b and 4c, 4d on the roller traverse 5. This is also approximately equal to the distance 9 of the cable fixed points 8a, 8b and 8c, 8d on the trolley frame 1.

As the cable drums 2a, 2b are of double-thread design, in the case of synchronously controlled runoff of the cables 3a, 3b, 3c, 3d, i.e., during the lowering of the roller support 5, the cables 3a, 3b, 3c, 3d run on the cable drums 2a, 2b in the inward direction and define the cable run path 15, so that the cable distance 10 (the maximum cable distance) will not increase.

The arrows 16 show the direction of travel of the trolley 1 on the container crane. The trolley 1 is moved either in the direction of the waterside jib or of the land-side support.

The spreader 17, to which the container 18 is slung for loading and unloading, is attached below the roller traverse 5.

By the arrangement of the invention as a maximum cable distance 10 with fully wound cable limits the distance of the cable roller pairs 4a, 4b, 4c and 4d as well as the distance of the cable fixed points 8a, 8b, 8c and 8d on the trolley frame 1. The dimension defined by the distance 13 and the dimension defined by the distance 14 may be minimized.

While a specific embodiment of the invention has been shown and described in detail to illustrate the application of the principles of the invention, it will be understood that the invention may be embodied otherwise without departing from such principles.

What is claimed is:

1. A container crane trolley hoisting arrangement, comprising:

a trolley frame;

a first motor driven cable drum supported on said trolley frame;

a second motor driven cable drum supported on said trolley frame;

a roller support connected to a spreader for engaging a container to be unloaded or loaded;

a first set of cable rollers connected to said roller support;

a second set of cable rollers connected to said roller support;

a first set of hoisting cables connected to said first cable drum in a double-thread design wherein said first set of cables is fed off of said first cable drum from an outer first cable drum location toward an inner cable drum location;

a second set of hoisting cables connected to said second cable drum in a double-thread design wherein said second set of cables is fed off of said second drum from an outer second cable drum location toward an inner cable drum location;

a first set of fixed cable points connected to said trolley frame and a second set of cable fixed points connected to said trolley from, said first set of hoisting cables extending to said first cable rollers and to said first set of cable fixed points and said second set of hoisting cables extending to said second set of cable rollers and to said second set of cable fixed points, said first cable drum being positioned parallel to said second cable drum and offset from said second cable drum by a distance equal to a diameter of said first cable drum and said second cable drum, said first set of cables at said outer position of said first cable drum being spaced a distance from said second set of cables at an outer position of said second cable drum at a distance approximately corresponding to a distance between said first set of cable rollers and said second set of cable rollers, when said first cable drum and said second cable drum are substantially fully wound, said first set of cable fixed points and said second set of cable fixed points being spaced a distance approximately equal to said distance between said first set of cable rollers and said second set of cable rollers, said first set of hoisting cables and said second set of hoisting cables running off said first drum and said second drum respectively in an inward direction during lowering of said spreader.

2. A container crane trolley hoisting arrangement according to claim 1, wherein:

each said first cable drum and said second cable drum is driven by a drive one motor via a gear mechanism.

* * * * *